United States Patent [19]

Zimmerman

[11] 4,177,987

[45] Dec. 11, 1979

[54] MARBLE GAME WITH SCOOP AND CUPS

[76] Inventor: Warren B. Zimmerman, 5 Vernon Hill Ct., Baltimore, Md. 21228

[21] Appl. No.: 894,765

[22] Filed: Apr. 10, 1978

[51] Int. Cl.[2] ..... A63F 7/00

[52] U.S. Cl. ..... 273/1 R

[58] Field of Search ..... 46/43; 273/1 R, 1 M, 273/144 A, 271; 294/19 A

[56] References Cited

U.S. PATENT DOCUMENTS

| | | | |
|---|---|---|---|
| 3,578,319 | 5/1971 | Kohner | 273/1 R |
| 3,578,320 | 5/1971 | Goldfarb | 273/1 G |
| 3,617,058 | 11/1971 | Goldfarb | 273/1 G |
| 3,724,848 | 4/1973 | Glass | 273/1 G |
| 3,866,918 | 2/1975 | Goldfarb | 273/271 |
| 4,111,429 | 9/1978 | Waski | 273/144 A X |

*Primary Examiner*—Harland S. Skogquist
*Attorney, Agent, or Firm*—Walter G. Finch

[57] ABSTRACT

The invention is a motor skill game apparatus that provides entertainment and competition. The game requires manual dexterity, coordination, skill, and some luck, it necessitates speed and attentiveness. The game apparatus consists of a box containing a plurality of simulated "moon rocks" (marbles), a platform on which the box is centrally located, a "spascoop" for each player for extracting the "moon rocks" from the box through apertures in the sides of the box, and cups in the platform for each player into which the "moon rocks" are transported by the "spascoop" after being extracted from the box. The "moon rocks" are colored to match each players platform area and as a means of scoring the efforts of each player.

6 Claims, 3 Drawing Figures

MARBLE GAME WITH SCOOP AND CUPS

BACKGROUND AND SUMMARY OF THE INVENTION

The invention relates generally to games of entertainment and competition and in particular to games of skill requiring manual dexterity, coordination, and some luck. Speed and attentiveness are necessary to play the game.

Games have been invented that relate to interests in all aspects of life and times. This game has a general relation to life in these times regarding trips to the moon to bring back samples of moon rocks. Simulated "moon rocks" (marbles) are used in the game.

It is, therefore, an object of the invention to provide a game generally related to the retrieval of rocks from the moon.

It is a further object of the invention to provide a game that will be entertaining and competitive for two or more players.

It is another object of the invention to provide a game of skill requiring manual dexterity, coordination, speed, and attentiveness.

Further objects and advantages of the invention will become more apparent in light of the following description of the preferred embodiments.

DESCRIPTION OF THE PREFERRED EMBODIMENTS

Figure 1:
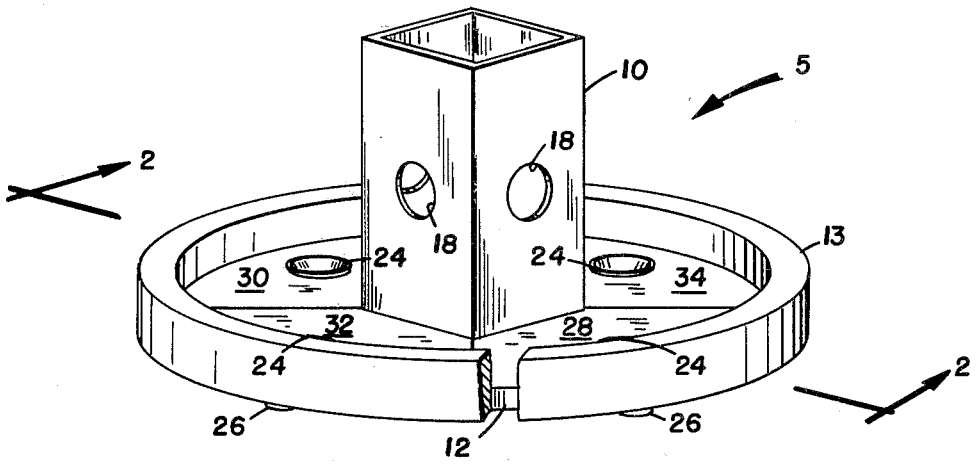
FIG. 1 is a perspective view of the game apparatus.

Referring to the drawings and particularly to FIG. 1, a new and useful game apparatus for a moon rocks game is shown at 5. The game apparatus 5 consists of a square box 10, open at the top and bottom, with an access aperture 18 centered on each of the four sides. The height of the square box 10 is the same as the length of one of the sides of the box 10; box 10 is essentially of a cube configuration with the top and bottom omitted.

Box 10 is centrally located on a circular base or platform 12. To secure box 10 in place on the base or platform 12, each corner of box 10 has a pin or leg 20 projecting from the bottom edges of box 10 and each pin or leg 20 extending into a hole 22 in the base or platform 12. The legs 20 can be seen in FIG. 2. When packing game apparatus 5, box 10 with four projecting legs 20 is removed intact from the platform 12, the legs 20 being removed easily from the four holes 22 in platform 12. Box 10 is then folded flat, with said legs 20 extending therefrom so that it may be packed on top of platform 12.

Platform 12 has a closed fence or barrier 13 surrounding its circular periphery and attached thereto by nails, rivets, glue, welding, or other suitable manner depending upon materials used. The fence or barrier 13 can be seen in FIG. 2. The platform 2 and the barrier 13 form a tray arrangement.

Platform 12 is divided into four quadrants or sections 28, 30, 32, and 34 as seen in FIG. 1. Each of the quadrants 28, 30, 32, and 34 is centered symmetrically on one side of box 10. Each of the four quadrants 28, 30, 32, and 34 are colored a different color; one red, one blue, one green and one yellow.

Referring now to FIG, 2, a cup 24 is placed in a hole 25 through the platform 12. One cup 24 is in each quadrant 28, 30, 32, and 34. Said cup 24 being of a slightly larger diameter than the hole 25 so that the top edge of cup 24 is slightly above the top plane or surface of platform 12 and cup 24 does not pass through hole 25 in platform 12. The holes 25 are centered within each quadrant 28, 30, 32, and 34, one hole 25 to each quadrant 28, 30, 32, or 34, and each located on a centerline of platform 12 between the barrier 13 and the centerline of the side of box 10 that faces the quadrant involved. Each hole 25 is located on said centerline of platform 12 at a position from the barrier 13 about one-third the distance between said barrier 13 and the side of box 10.

A plurality of rubber-like legs or supports 26 are assembled on the underside of platform 12 to maintain clearance from the table or other surface on which the game apparatus 5 is placed for game play; such clearance is for the protruding cups 24 and other projections that may occur on the underside of the platform 12, depending on construction configurations. The rubber-like legs 26 also prevent the game apparatus 5 from moving or sliding during play.

Materials used for construction of the game apparatus 5 may be wood, metal, plastics or other suitable materials, or a combination of two or more such materials. It is to be understood that any variation in materials, variation of the box 10 from four sides to a lesser or greater number of sides, variation of the configuration of the cups 24, supports 26, or other parts, variation of colors of the quadrants 28, 30, 32, and/or 34, or any other configuration or assembly variation is within the scope and intent of this invention.

Figure 2:
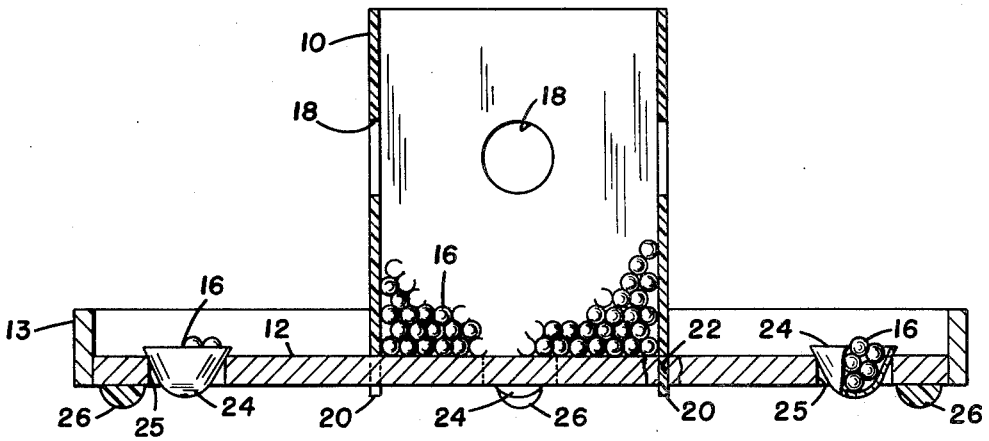
FIG. 2 is a sectional view taken along the line 2—2 of FIG. 1 showing simulated "moon rocks" within the game apparatus.
Figure 3:
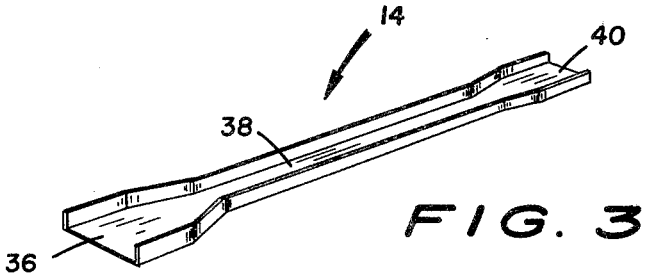
FIG. 3 is a perspective view of the "spascoop" used in the game to extract simulated "moon rocks" from the game apparatus.

Use of the game apparatus 5 requires two other elements to play the Moon Rock Game, simulated "moon rocks" in the form of marbles 16 as seen in FIG. 2, and a "spascoop" 14 as seen in FIG. 3.

For the Moon Rock Game, 60 marbles 16 are needed, 15 marbles 16 of each color the same as the colors of the quadrants 28, 30, 32, and 34 (in this embodiment the four sets of 15 marbles 16 would be one set of red, blue, green and yellow). Total depends on number of quadrants. The marbles are the means of scoring in the game. The marbles are shown in the box 10 in FIG. 2. The marbles may be of any material.

The "spascoop" 14 is composed of a trough section 38, with flanged-type troughs 36 and 40 at each end. The "spascoop" is a manipulating device for each player. The trough 38 and flanged troughs 36 and 40 are essentially flat bottom with turned up sides. Trough 38 is slightly wider than a marble 16 so that a marble 16 will roll through trough 38 when tilted at an incline. Flanged trough 36 may be the same size as flanged trough 40 or preferably slightly larger as hereinafter described. Color of spascoop 14 preferably matches color of marbles 16 with which associated.

The "spascoop" 14 is inserted through the aperture 18 in box 10 so that one flanged trough (36 or 40) may be held in the hand (trough side up), and the other flanged trough (36 or 40) may be used to scoop up a marble or marbles from the supply in box 10. When the width of flanged trough 36 is slightly larger than the aperture 18 (and concurrently larger than flanged trough 40), the "spascoop" 14 is inserted through aperture 18 from inside the box 10 (flanged end 40 passing through the aperture 18 and flanged end 36 being prevented by size from passing through). In this latter arrangement the "spascoop" 14 cannot be withdrawn from the aperture 18 in box 10 during play of the game (this being one of the usual rules).

All player (one at each of the quadrants 28, 30, 32, and 34) begin play at the same moment on signal from a referee or a designated player (such as player "green" saying "go").

The game objective is for each player to scoop up marbles 16 of the same color as the player's quadrant (28, 30, 32, or 34). This is done by manipulating the end of the "spascoop" within box 10 to scoop up one or more marbles 16, raise the end of the "spascoop" inside the box 10 by moving the end of the "spascoop" 14 in the hand downward, and thereby having the marble or marbles 16 roll down through trough 38 and out through the flanged trough 40. If the color of marbles 16 in the "spascoop" 14 are not the correct color, they may be dumped in the box 10 by raising or turning the outside end of "spascoop" 14.

As the captured marbles 16 ("moon rocks") roll through trough 38 and out through flanged trough 40, the player is to guide the marbles 16 into the cup 24. This must be done without touching the captured marbles 16 with the hand or fingers. Captured marbles 16 ("moon rocks") of the proper color each count one point. Marbles 16 that do not go into or stay in the cup 24 are "dead". Captured marbles 16 of a color different than the color of the quadrant (28, 30, 32, or 34) concerned carry a penalty of subtraction of one point for each such marble 16 captured from the player's score of properly captured marbles 16. Marbles 16 touched by the hand must be returned to the box 10, except that all captured marbles 16 of the wrong color are placed in the player's cup 24, regardless of whether touched or guided into cup 24.

When all marbles 16 of any one color are out of the box 10, the game is over and scores are totaled as aforementioned. The highest score wins, players may sit or stand while playing.

Game may be played as partners, where players opposite each other are a team. However, each player must capture only marbles 16 of the designated color of the quadrant 28, 30, 32, or 34. Partners may assist each other in removing the designated colors.

To contain "dead" "moon rocks" within the quadrant, low barrier strips (not shown in the drawings) may be placed along the quadrant lines between the quadrants 28 and 32, 32 and 30, 30 and 34, and 34 and 28, either fastened to the platform 12 by suitable means or made an integral part of platform 12.

As can be readily understood from the foregoing description of the invention, the present structure can be configured in different modes to provide the ability to play essentially the game of "moon rocks" as hereinbefore presented.

Accordingly, modifications and variations to which the invention is susceptible may be practiced without departing from the scope and intent of the appended claims.

What is claimed is:

1. In a game of entertainment and skill for competition, coordination, and dexterity, having a game apparatus, removably associated game objects, and player units, which comprise:

a game apparatus structure;

a plurality of game scoring objects placed within said game apparatus structure;

a plurality of player manipulation devices to extract said game scoring object from said game apparatus structure, a platform having a peripheral barrier encircling said platform and attached thereto by suitable means;

an open-ended container of more than two sides for said game scoring objects, centrally located on and removably attached to said platform on one of open ends of said container, and having an access aperture centrally located in each side thereof;

a plurality of cup-like containers removably located and set in apertures in said platform, one each in said platform opposite each side of said open ended container, for holding extracted game scoring objects from said open-ended container; and a plurality of rubber-like legs on the bottom surface of said platform and attached thereto by suitable means, said rubber-like legs providing clearance for said cup-like containers extending through platform, and further preventing movement of said game apparatus structure during play of game.

2. The game apparatus structure recited in claim 1 and additionally having the top surface of said platform marked into sections corresponding to the number of sides of said open-ended container, each said section being opposite to and adjacent to a side of said open-ended container, each said section being finished in a different color.

3. The game apparatus recited in claim 2 and additionally a barrier at the juncture of each said section with the adjacent section, said barrier attached to said platform.

4. The game recited in claim 3, wherein said plurality of game scoring objects consists of a plurality of spherical means in equal numbers for each player in the game, each quantity for a player being of a different color and corresponding to said different colors of said sections marked on said platform.

5. The game recited in claim 4, wherein said plurality of player manipulation devices are rod-like, the rod-like devices being channel-shaped to form a trough, and additionally said trough being flanged for a portion at each end to form a scoop-like configuration at each end, center portion of said trough being of a width to permit said spherical means to roll freely through said trough, said plurality of player manipulation devices being one for each player and color matching said different colors of said spherical means with which associated.

6. The game recited in claim 5 wherein said game is played by two or more players up to the number of said sections marked on said platform, all said players concurrently starting to play on a signal, each said player manipulation said player manipulation device to extract said game scoring objects through said access aperture in said open-ended container at said section at which said player is located and guiding said game scoring objects into said cup-like container, each said player extracting colored spherical means corresponding to color of section at which said player is located, game ceasing when all spherical means of any one color have been extracted, scoring one point for each properly colored spherical means in said cup-like container minus one point for each incorrect colored spherical means extracted, spherical means of proper color that are not in said cup-like container and spherical means touched by hand or fingers of player are dead and not counted in scoring, player with highest total is the winner.

* * * * *